US012163230B2

(12) United States Patent
Fontaine

(10) Patent No.: US 12,163,230 B2
(45) **Date of Patent: *Dec. 10, 2024**

(54) DEVICE FOR COATING A METAL STRIP WITH SEPARATELY MOVABLE ELECTROMAGNETIC STABILIZING DEVICE AND BLOWING DEVICE

(71) Applicant: Fontaine Engineering und Maschinen GmbH, Langenfeld (DE)

(72) Inventor: Dominique Fontaine, Langenfeld (DE)

(73) Assignee: Fontaine Engineering und Maschinen GmbH, Langenfeld (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/341,255

(22) Filed: Jun. 26, 2023

(65) Prior Publication Data

US 2023/0399731 A1 Dec. 14, 2023

Related U.S. Application Data

(63) Continuation of application No. 15/528,572, filed as application No. PCT/EP2015/071859 on Oct. 2, 2015, now Pat. No. 12,018,379.

(30) Foreign Application Priority Data

Nov. 21, 2014 (DE) ..... 10 2014 223 818.8

(51) Int. Cl.
*C23C 2/20* (2006.01)
*C23C 2/00* (2006.01)
(Continued)

(52) U.S. Cl.
CPC ..... *C23C 2/20* (2013.01); *C23C 2/003* (2013.01); *C23C 2/00344* (2022.08);
(Continued)

(58) Field of Classification Search
CPC ..... C23C 2/003
See application file for complete search history.

(56) References Cited

U.S. PATENT DOCUMENTS 3,430,174 A 2/1969 Kogo et al.
3,518,109 A 6/1970 Halley
(Continued)

FOREIGN PATENT DOCUMENTS

CA 2794925 A1 * 5/2011 ..... C23C 2/003
CN 101151396 A 3/2008
(Continued)

OTHER PUBLICATIONS

Peter Lofgren et. al, Electromagnetic Strip Stabilizer for Hot Dip Galvanizing Lines, Presented at the Galvanizers Association 97th Meeting Lexington, KY, Oct. 16-19, 2005.

*Primary Examiner* — Karl Kurple
(74) *Attorney, Agent, or Firm* — Smartpat PLC

(57) ABSTRACT

A device for coating a metal strip with a liquid coating material comprises a coating container filled with, for example, liquid zinc. After the metal strip exits the coating container, liquid coating material adheres to the metal strip. Excess coating material is blown away from the surface of the metal strip by a blowing device. Thereafter, the metal strip runs through an electromagnetic stabilization device which is supported on the blowing device. Disturbing influences may cause the metal strip to no longer run centrally through a slot of the blowing device. A displacement or re-alignment of the blowing device is then required to guide the metal strip back to the set middle position. A first displacing device displaces the electromagnetic stabilization device relative to the blowing device in the plane transverse to the direction of transport of the metal strip to avoid an undesirable displacement of the electromagnetic stabilization device.

6 Claims, 2 Drawing Sheets

(51) Int. Cl.
*C23C 2/06* (2006.01)
*C23C 2/18* (2006.01)
*C23C 2/24* (2006.01)

(52) U.S. Cl.
CPC ..... *C23C 2/0035* (2022.08); *C23C 2/06* (2013.01); *C23C 2/18* (2013.01); *C23C 2/24* (2013.01); *C23C 2/51* (2022.08); *C23C 2/524* (2022.08); *C23C 2/5245* (2022.08); *C23C 2/526* (2022.08)

(56) References Cited

U.S. PATENT DOCUMENTS

| | | | | |
|---|---|---|---|---|
| 3,635,748 | A | 1/1972 | Peoples | |
| 3,661,116 | A | 5/1972 | Moskowitz et al. | |
| 3,778,122 | A | 12/1973 | Doll et al. | |
| 4,135,006 | A * | 1/1979 | Readal | G05D 5/03 73/150 R |
| 4,444,814 | A | 4/1984 | Flinchum et al. | |
| 4,517,540 | A | 5/1985 | McDougal | |
| 4,612,215 | A | 9/1986 | Hennechart et al. | |
| 4,994,738 | A | 2/1991 | Soyck et al. | |
| 5,384,166 | A | 1/1995 | Sato et al. | |
| 5,965,210 | A | 10/1999 | Tada et al. | |
| 6,194,022 | B1 | 2/2001 | Schunk | |
| 6,471,153 | B1 * | 10/2002 | Kimura | B21C 47/34 226/93 |
| 8,062,711 | B2 | 11/2011 | Löfgren et al. | |
| 8,474,382 | B2 | 7/2013 | Bourgier et al. | |
| 8,616,148 | B2 | 12/2013 | Fujioka et al. | |
| 8,752,502 | B2 | 6/2014 | Eriksson et al. | |
| 10,190,203 | B2 | 1/2019 | Fontaine et al. | |
| 10,650,951 | B2 | 5/2020 | Sakai et al. | |
| 11,255,009 | B2 | 2/2022 | Behrens et al. | |
| 11,549,168 | B2 | 1/2023 | Fontaine et al. | |
| 2003/0077397 | A1 | 4/2003 | Kabeya et al. | |
| 2003/0113460 | A1 | 6/2003 | Even et al. | |
| 2004/0050323 | A1 * | 3/2004 | Chae | C23C 2/20 118/100 |
| 2007/0220940 | A1 | 9/2007 | Patzelt et al. | |
| 2008/0044584 | A1 * | 2/2008 | Eriksson | C23C 2/003 427/430.1 |
| 2009/0175708 | A1 * | 7/2009 | Lofgren | C23C 2/0035 414/225.01 |
| 2009/0191360 | A1 | 7/2009 | Teramoto et al. | |
| 2009/0280270 | A1 | 11/2009 | Behrens et al. | |
| 2010/0209591 | A1 * | 8/2010 | Eriksson | C23C 2/003 427/8 |
| 2010/0282161 | A1 | 11/2010 | Fujioka et al. | |
| 2010/0285239 | A1 | 11/2010 | Behrens et al. | |
| 2011/0177258 | A1 | 7/2011 | Ernst et al. | |
| 2012/0159901 | A1 | 6/2012 | Capriotti et al. | |
| 2013/0010397 | A1 | 1/2013 | Ohara et al. | |
| 2013/0232811 | A1 | 9/2013 | Koga et al. | |
| 2013/0319326 | A1 | 12/2013 | Guastini et al. | |
| 2013/0327806 | A1 | 12/2013 | Jang et al. | |
| 2014/0027216 | A1 | 1/2014 | Ohara et al. | |
| 2014/0144967 | A1 | 5/2014 | Jang et al. | |
| 2014/0211361 | A1 | 7/2014 | Kurisu et al. | |
| 2017/0009326 | A1 | 1/2017 | Yonekura et al. | |
| 2017/0088381 | A1 | 3/2017 | Kurisu et al. | |
| 2017/0268092 | A1 * | 9/2017 | Fontaine | B05D 1/18 |
| 2017/0283929 | A1 | 10/2017 | Fontaine | |
| 2018/0151284 | A1 | 5/2018 | Sakai et al. | |
| 2018/0155814 | A1 * | 6/2018 | Fontaine | C23C 2/00344 |
| 2018/0363116 | A1 | 12/2018 | Fontaine | |
| 2019/0194791 | A1 | 6/2019 | Behrens et al. | |
| 2019/0390315 | A1 | 12/2019 | Yonekura et al. | |
| 2020/0047234 | A1 | 2/2020 | Yonekura et al. | |
| 2020/0346264 | A1 | 11/2020 | Yonekura et al. | |
| 2022/0049339 | A1 | 2/2022 | Behrens et al. | |

FOREIGN PATENT DOCUMENTS

| | | | | |
|---|---|---|---|---|
| CN | 101376961 | A | 3/2009 | |
| CN | 101784689 | A | 7/2010 | |
| CN | 102597295 | A | 7/2012 | |
| CN | 202401120 | U | 8/2012 | |
| CN | 205046185 | U | 2/2016 | |
| CN | 110352262 | B | 4/2021 | |
| DE | 2137850 | A1 | 2/1973 | |
| DE | 102008039244 | A1 | 3/2009 | |
| DE | 102007045202 | A1 | 4/2009 | |
| DE | 102009051932 | A1 | 5/2011 | |
| DE | 202015104823 | U1 | 10/2015 | |
| DE | 102015216721 | B3 | 11/2016 | |
| JP | S62194756 | U | 12/1987 | |
| JP | H02277755 | A | 11/1990 | |
| JP | H0530148 | U | 4/1993 | |
| JP | H08199323 | A | 8/1996 | |
| JP | H08302455 | A | 11/1996 | |
| JP | H10298727 | A | 11/1998 | |
| JP | 2002285309 | A | 10/2002 | |
| JP | 2003113460 | A | 4/2003 | |
| JP | 3706473 | B2 | 10/2005 | |
| JP | 2009167473 | A | 7/2009 | |
| JP | 2012102389 | A | 5/2012 | |
| JP | 2017013114 | | 1/2017 | |
| KR | 19990044375 | A | 6/1999 | |
| KR | 20100030664 | A | 3/2010 | |
| KR | 20100074979 | A | 7/2010 | |
| KR | 20120063550 | A | 6/2012 | |
| RU | 2296179 | C2 | 3/2007 | |
| RU | 2436861 | C1 | 12/2011 | |
| RU | 2482213 | C2 | 5/2013 | |
| RU | 2557044 | C2 | 7/2015 | |
| WO | 0111101 | A1 | 2/2001 | |
| WO | 2006006911 | A1 | 1/2006 | |
| WO | 2006021437 | A1 | 3/2006 | |
| WO | 2009024353 | A2 | 2/2009 | |
| WO | 2009039949 | A1 | 4/2009 | |
| WO | WO-2012172648 | A1 * | 12/2012 | C23C 2/14 |
| WO | 2013168668 | A1 | 11/2013 | |
| WO | 2016078803 | A1 | 5/2016 | |
| WO | 2017036703 | | 3/2017 | |

* cited by examiner

DEVICE FOR COATING A METAL STRIP WITH SEPARATELY MOVABLE ELECTROMAGNETIC STABILIZING DEVICE AND BLOWING DEVICE

TECHNICAL FIELD

The disclosure relates to a method and a device for coating a metal strip with an initially still liquid coating material, for example zinc. The method and the device serve for, in particular, hot-dip galvanizing of the metal strip.

BACKGROUND

Devices for coating a metal strip are generally known in the prior art, for example from DE 10 2009 051 932 A1. In concrete terms, this specification discloses a coating container filled with a liquid coating material. For coating, the metal strip is passed through the container with the coating material. After leaving the coating container the metal strip runs through a blowing device, which is arranged above the coating container, for blowing excess parts of the still liquid coating material off the surface of the metal strip. An electromagnetic stabilizing device for stabilizing the metal strip after leaving the coating container and the blowing device is arranged above the blowing device and is supported by the blowing device. The electromagnetic stabilizing device has the effect, in particular, that the strip is held centrally in a center plane of the overall device and that oscillations of the metal strip during transit through the coating container and the blowing device are prevented or at least reduced.

Not only the blowing device, but also the electromagnetic stabilizing device have a respective slot through which the metal strip is guided. In order to achieve a uniform thickness or thickness distribution of the coating material on the upper side and lower side of the metal strip it is essential for the metal strip to run in a predetermined target center position through the slot of the blowing device. Only then is it guaranteed that the action of the blowing nozzles on the upper side and lower side of the metal strip is the same and a desired uniform thickness distribution of the coating material on the metal strip arises.

The target center position is defined by, in particular, a preferably uniform spacing of the wide sides and the narrow sides of the metal strip from the opposite sides of the slot of the blowing device and, in particular, by the fact that the metal strip is neither inclined nor twisted relative to the longitudinal orientation of the slot.

However, due to disturbing influences it can happen that the metal strip moves out of the predetermined target center position and thus its actual position deviates from the target center position. Traditionally, a possible deviation of the actual position of the metal strip from the said target center position is accordingly monitored by an operator and in a given case the blowing device is so displaced in a plane perpendicular to the transport direction of the metal strip that the metal strip is again guided in the predetermined target center position in the slot of the blowing device. However, a displacement of that kind of the blowing device has the disadvantage that, as a result, the electromagnetic stabilizing device is also correspondingly displaced therewith, because this electromagnetic stabilizing device is traditionally—as described in, for example, DE 10 2008 039 244 A1—fixedly connected with the blowing device apart from a degree of freedom in vertical direction and is supported on this device. The stated disturbance of the guidance of the metal strip through the slot of the blowing device does not, however, necessarily have an effect on the guidance of the metal strip through the slot of the electromagnetic stabilizing device. Accordingly, the simultaneous displacement, which is described in DE 10 2008 039 244 A1, of the electromagnetic stabilizing device together with the blowing device is in principle undesired, because this leads to an asymmetrical and thus undesired change in the action of force of the electromagnetic stabilizing device on the metal strip.

SUMMARY

An object of the present disclosure is to improve a known method and a known device for coating a metal strip in such a way that a desired displacement of the electromagnetic stabilizing device is prevented in the case of displacement of the blowing device.

This method is characterized by the following method step: displacing the electromagnetic stabilizing device relative to the blowing device in a plane transverse to the transport direction of the metal strip so that the actual position of the metal strip at least approximately corresponds with a predetermined target center position in the slot of the electromagnetic stabilizing device.

The electromagnetic stabilizing device is also termed Dynamic Electro Magnetic Coating Optimizer (DEMCO®) by the Applicant.

Through this method step a relative movement of the electromagnetic stabilizing device with respect to the blowing device is made possible and thus it is advantageously ensured that a displacement of the blowing device does not necessarily lead to an undesired displacement of the electromagnetic stabilizing device. In concrete terms, the metal strip can, in particular, be kept in the slot of the electromagnetic stabilizing device, preferably in a target center position, even if the blowing device moves in a plane transverse to the transport direction of the metal strip. For this purpose, the electromagnetic stabilizing device is moved relative to the blowing device in precisely the opposite direction to the blowing device (compensation).

Advantageously, through this method step correct functioning of the electromagnetic stabilizing device is ensured even when the blowing device has to be displaced for reinstating guidance of the metal strip in the target center position through the slot of the blowing device.

According to a first embodiment, deviation of the actual position of the metal strip from a predetermined target center position in the slot of the blowing device is detected and the actual position of the metal strip is regulated to the predetermined target center position by suitable displacement of the blowing device in a plane transverse to the transport direction of the metal strip.

The displacement of the electromagnetic stabilizing device in accordance with the invention can be carried out either as a function of the detected deviation of the actual position of the metal strip from the predetermined target center position in the slot of the blowing device or as a function of and in opposite direction to the detected displacement, which is carried out, of the blowing device; in the case of the latter alternative, detection of the displacement of the blowing device takes place relative to a pass line reference position. The pass line reference position is then defined by the constructional installation center as defined by, in particular, the fixed position of a first deflecting roller for the metal strip within the coating container and the fixed position of a second deflecting roller above the stabilizing device.

Alternatively, deviation of the actual position of the metal strip from the predetermined target center position in the slot of the electromagnetic stabilizing device is detected and the displacement of the electromagnetic stabilizing device in accordance with the invention is carried as a function of the detected deviation of the actual position of the metal strip from the predetermined target center position in the slot of the electromagnetic stabilizing device.

The detected deviation of the actual position of the metal strip from its target center position in the slot of the electromagnetic stabilizing device or the blowing device can be either a translational shifting parallel to a longitudinal direction defined by the target center position or a rotation relative to the predetermined target center position. These two forms of deviation of the actual position from the target center position of the metal strip or a corresponding shifting or rotation of the electromagnetic stabilizing device are also termed skew function by the Applicant.

Alternatively, the detected deviation of the actual position of the metal strip is a translational shifting in width direction x (relative) to the predetermined target center position of the metal strip in the slot of the electromagnetic stabilizing device or blowing device. A deviation of that kind of the actual position from the target center position of the metal strip or a corresponding shifting of the electromagnetic stabilizing device is also termed scan function by the Applicant.

In terms of the device, the above-mentioned object is fulfilled by the device as claimed. The advantages of this solution correspond with the advantages mentioned above with respect to the disclosed method.

Advantageous embodiments of the device are the subject of the dependent claims. In a particularly advantageous embodiment the device comprises a human machine interface (HMI) for an operator of the device for visualization of, for example, the detected deviation of the actual position of the metal strip from the target center position in the slot of the blowing device or in the slot of the electromagnetic stabilizing device or for visualization of the detected deviation of the blowing device from the pass line reference position or for visualization of the change in the stated deviations over time. Performance of the method is substantially simplified by visualization of that kind of the deviations or the changes in time thereof.

BRIEF DESCRIPTION OF THE DRAWINGS

Accompanying the invention are three figures, in which.

DETAILED DESCRIPTION

Figure 1:
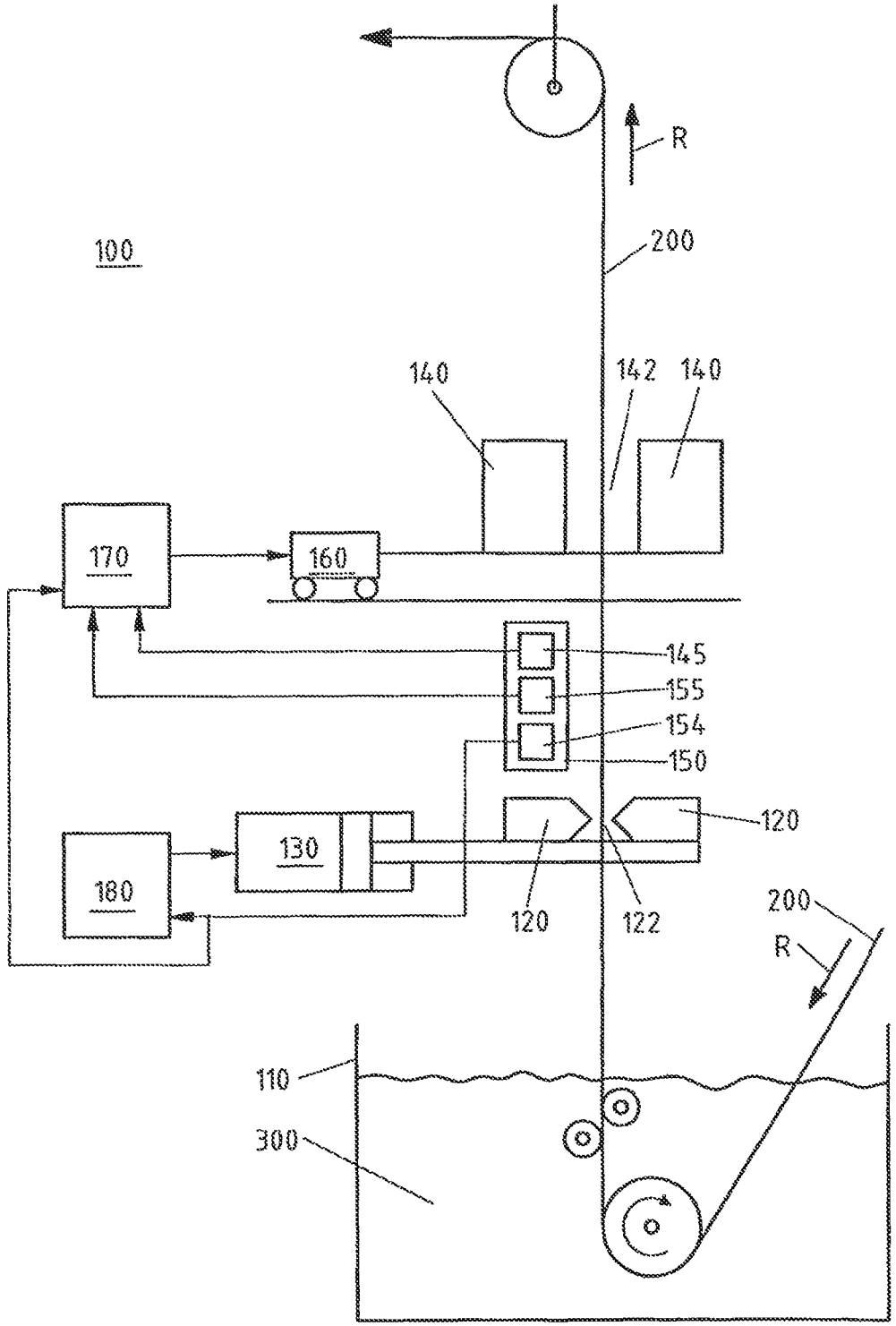
FIG. 1 shows the device according to the invention.

The invention is described in detail in the following in the form of embodiments with reference to the mentioned figures. The same technical elements are denoted by the same reference numerals in all figures.

FIG. 1 shows the device 100 according to the invention for coating a metal strip 200 with a liquid coating material 300, for example zinc. For this purpose, the initially still uncoated metal strip 200 is fed in transport direction R in a coating container 110 filled with the liquid coating material. Within the coating container 110 the metal strip 200 is deflected with the help of a deflecting roller so that it leaves the coating container at the top. After the transit through the coating container, the still liquid coating material adheres to the metal strip 200.

Arranged above the coating container 110 is a blowing device 120 which spans a slot 122 through which the metal strip 200 is guided. Excess coating material is blown off the surface of the metal strip 200 with the help of the blowing device.

Figure 2:
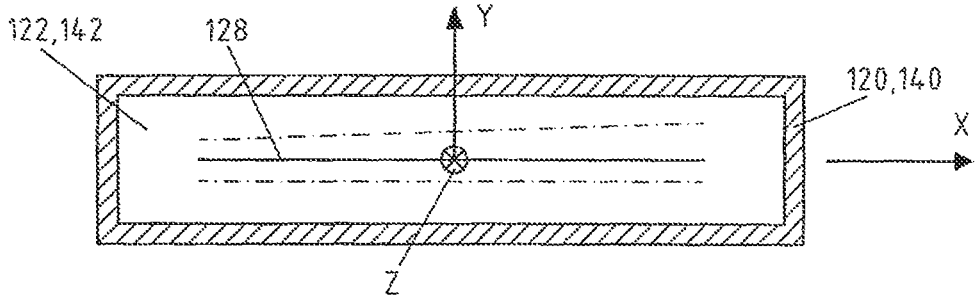
FIGS. 2 and 3 show plan views of the slot of a blowing device or the electromagnetic stabilizing device each with marking of the target center position and different desired actual positions of the metal strip.

In order that blowing onto the upper side and lower side of the metal strip 200 takes place uniformly it is important that the metal strip 200 runs through the slot 122 of the blowing device 120 in a predetermined target center position 128, as symbolized in FIG. 2 in the form of the solid line in X direction. This target center position is distinguished by, in particular, uniform spacings or spacing distributions from the inner edges of the slot 122 of the blowing device 120. Possible undesired actual positions of the metal strip are also drawn, as dashed lines, in FIG. 2 near the desired predetermined target center position. Undesired actual positions for the metal strip are thus present, for example, if it is twisted relative to the target center position or shifted parallelly in Y direction.

Figure 3:
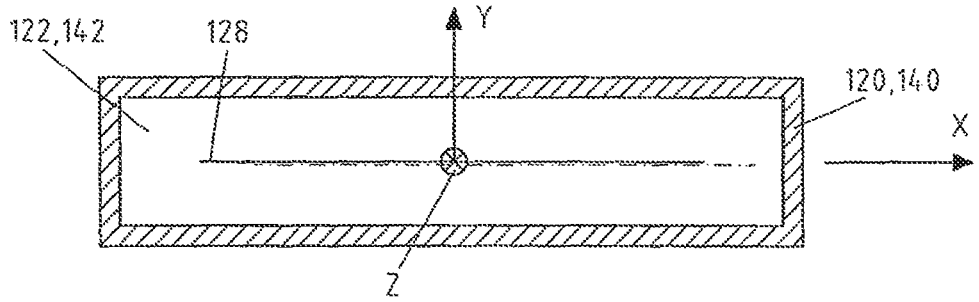

FIG. 3 shows a third possible undesired actual position, in which the metal strip 200 is parallelly shifted in X direction, i.e., in width direction, relative to the target center position.

With further reference to FIG. 1 there can be seen above the blowing device 120 an electromagnetic stabilizing device 140 which in turn has a slot 142 through which the metal strip 200 is similarly guided. It is also the case here that the metal strip 200 runs through the slot 142 preferably in a predetermined target center position 128, as shown in FIGS. 2 and 3, so that the forces provided by the electromagnetic stabilizing device 140 can have a stabilizing action in desired manner uniformly on the metal strip 200. The same applies to the slot 142 and the center position, which is also desired thereat, as beforehand with reference to FIGS. 2 and 3 for the slot 122 of the blowing device 120.

The electromagnetic stabilizing device 140 is mechanically supported on the blowing device 120. However, according to the invention this support is not carried out rigidly, but by way of a first displacing device 160 provided between the blowing device 120 and the electromagnetic stabilizing device 140. In concrete terms, the first displacing device 160 enables displacement of the electromagnetic stabilizing device 140 relative to the blowing device in a plane transverse to the transport direction R of the metal strip. The displacing device 160 is controlled with the help of a control device 170.

In addition, a first detecting device 154 for detecting a deviation of the actual position of the metal strip 200 from a predetermined target center position in the slot 122 of the blowing device 120 is arranged between the stabilizing device 140 and the blowing device 120. Alternatively, the first detecting device 154 can also be constructed only for detection of the actual position of the metal strip. Moreover, a regulating device 180 is provided for regulating the actual position of the metal strip 200 to a predetermined target center position in the slot 122 of the blowing device, as explained above with reference to FIGS. 2 and 3, through displacement of the blowing device 120 with the help of a second displacing device 130. The regulation is carried out in response to the detected deviation. If determination of the deviation of the actual position from the target center position does not take place in the first detecting device 154, it can also be undertaken, for example, within the regulating device 180. The displacement is carried out in a plane transverse to the transport direction R of the metal strip as a function of the detected deviation of the actual position of the metal strip from the predetermined target center position in the slot 122 of the blowing device. In other words, if it is ascertained that the metal strip 200 does not run through the slot 122 in the target center position 128, then the blowing device 120 is so displaced with the help of the second displacing device 130 that the metal strip again runs through the slot 122 of the blowing device in the predetermined target center position 128. For that purpose, the first detecting device 154 is constructed so that it can preferably detect all three actual positions of the metal strip 200 deviating from the target center position 128 as described above with reference to FIGS. 2 and 3.

The said displacement of the blowing device 120 does not have to have an effect on the electromagnetic stabilizing device 140, which is supported on the blowing device 120. For that purpose, the control device 170 is constructed to control the first displacing device 160 in such a way that the electromagnetic stabilizing device 140 in the case of a displacement of the blowing device 120 relative to a pass line reference position is not moved therewith but can remain at its original location. The control device 170 accordingly acts in such a way on the first displacing device 160 that in the case of a displacement of the blowing device 120 the electrical stabilizing device 140 makes precisely the opposite movement to the blowing device 120. As a result, the electrical stabilizing device 140 remains at its original location.

In order to realize this special form of control for the first displacing device 160 the control device 170 can evaluate different situations. On the one hand, the control device 170 can be constructed to perform displacement of the electromagnetic stabilizing device 140 as a function of the deviation, which is detected by the first detecting device 154, of the actual position of the metal strip from the predetermined target center position of the metal strip in the slot 122 of the blowing device 120. The first detecting device 154 is operatively connected to the regulating device 180.

Alternatively or additionally, the control device 170 can be constructed to perform the displacement of the electromagnetic stabilizing device as a function of and in opposite direction to the displacement of the blowing device 120, which is detected by a second detecting device 155. The second detecting device 155 is operatively connected to the control device 170.

Finally, according to a further alternative or additionally the control device 170 can be constructed to cause displacement of the electromagnetic stabilizing device 140 as a function of a detected deviation of the actual position of the metal strip from a predetermined target center position in the slot 142 of the electromagnetic stabilizing device. A precondition for that is that a third detecting device 145 is present for detecting the said deviation of the actual position of the metal strip from the predetermined target center position in the slot 142 of the electromagnetic stabilizing device 140. The third detecting device 145 is operatively connected to the control device 170.

The first, second and third detecting devices 154, 155, 145 are constructed to preferably recognize all conceivable deviations of an actual position of the metal strip from the desired target center position. Amongst those is, in particular, a (parallel) shifting of the metal strip in X or Y direction or a rotation such as explained above with reference to FIGS. 2 and 3. Accordingly, the first and second displacing devices 130, 160—in the case of suitable control by the regulating device 180 or the control device 170—are constructed to move the blowing device 120 and the electromagnetic stabilizing device 140 in a desired manner in a plane transverse to the transport direction R of the metal strip, particularly to shift (parallelly) or to rotate so as to realize running-through of the metal strip in the target center position. To that extent, the illustration of the first and second displacing devices 160, 130 as a carriage or piston-cylinder unit is in each instance merely exemplifying, but not limiting.

The first and third detecting devices 154, 145 as well as optionally also the second detecting device 155 can be realized in the form of a single sensor device 150, which, for example, is constructed in confocal manner or is laser assisted. To that extent, the sensor device—also termed 'laser' for short—forms a constructional unit for the mentioned detecting devices. The sensor device 150 can also be generally termed spacing detection device.

REFERENCE NUMERAL LIST

100 device
110 coating container
120 blowing device
122 slot of the blowing device
128 target center position of the metal strip in the blowing device or the electromagnetic stabilizing device
130 second displacing device
140 electromagnetic stabilizing device
142 slot of the electromagnetic stabilizing device
145 third detecting device
150 sensor device
154 first detecting device
155 second detecting device
160 first displacing device
170 control device
180 regulating device
200 metal strip
300 coating material
R transport direction of the metal strip
X width direction of the metal strip in target center position
Y direction transverse to the plane spanned by the metal strip

The invention claimed is:

1. A device (100) for coating a metal strip (200), comprising:

a coating container (110) filled with a liquid coating material (300) for coating a surface of the metal strip (200) as the metal strip (200) passes through the coating container (110); a blowing device (120) arranged above the coating container (110) for blowing excess parts of the liquid coating material (300) off the surface of the metal strip (200) as the metal strip (200) passes through a slot (122) of the blowing device (120);

an electromagnetic stabilizing device (140) for stabilizing the metal strip (200), the electromagnetic stabilizing device (140) being arranged above the blowing device (120) and supported by the blowing device (120); and a first displacing device (160) for displacing the electromagnetic stabilizing device (140) relative to the blowing device (120), the first displacing device (160) being arranged between the blowing device (120) and the electromagnetic stabilizing device (140);

a control device (170) operatively connected to the first displacing device (160) for controlling the first displacing device (160);

a second displacing device (130) for displacing the blowing device (120);

a regulating device (180) operatively connected to the second displacing device (130); and a first detecting device (154) for detecting a deviation of an actual position of the metal strip (200) from a predetermined target center position in the slot (122) of the blowing device (120), the first detecting device (154) being operatively connected to the regulating device (180);

wherein the regulating device (180) is configured to control the second displacing device (130) to displace the blowing device (120) so that the metal strip (200) maintains a target center position within the slot (122), wherein the regulating device (180) controls the second displacing device (130) to displace the blowing device (120) in response to the deviation of the actual position of the metal strip (200) from the predetermined target center position in the slot (122) detected by the first detecting device (154), and wherein the control device (170) is configured to control the first displacing device (160) to move the electromagnetic stabilizing device (140) and compensate for a displacement of the blowing device (120).

2. The device (100) for coating a metal strip (200) according to claim 1, wherein the first detecting device (154) is operatively connected to the control device (170), and wherein the control device (170) is configured to control the first displacing device (160) to move the electromagnetic stabilizing device (140) in response to the detected deviation of the actual position of the metal strip (200) from the predetermined target center position in the slot (122) of the blowing device (120).

3. The device (100) for coating a metal strip (200) according to claim 1, further comprising a second detecting device (155) for detecting a deviation of the blowing device (120) relative to a pass line reference position, the pass line reference position being defined by fixed positions of a first deflecting roller arranged within the coating container and a second deflecting roller arranged above the stabilizing device, wherein the control device (170) is configured to control the first displacing device (160) to move the electromagnetic stabilizing device (140) in opposite direction to the displacement of the blowing device relative to the pass line reference position detected by the second detecting device (155).

4. The device (100) according to claim 3, further comprising a human machine interface (HMI) configured to visualize the deviation of the blowing device (120) from the pass line reference position which has been detected by the second detecting device.

5. The device (100) for coating a metal strip (200) according to claim 1, further comprising a third detecting device (145) for detecting a deviation of an actual position of the metal strip (200) from a predetermined target center position in a slot (142) of the electromagnetic stabilizing device (140), the further detecting device (145) being operatively connected to the control device (170), wherein the control device (170) is configured to move the electromagnetic stabilizing device (140) in response to the deviation of the actual position of the metal strip (200) from the predetermined target center position in the slot (142) of the electromagnetic stabilizing device (140) detected by the third detecting device (145).

6. The device (100) according to claim 1, further comprising a human machine interface (HMI) configured to visualize the deviation of the actual position of the metal strip (200) from the target center position in the slot (122, 142) of the blowing device (120) detected by the first detecting device.

* * * * *